US010355379B1

(12) United States Patent
Lewis et al.

(10) Patent No.: US 10,355,379 B1
(45) Date of Patent: Jul. 16, 2019

(54) CONDUCTOR ASSEMBLY WITH A CRIMPED TUBULAR FERRULE AND METHOD OF MANUFACTURING SAME

(71) Applicant: Delphi Technologies, LLC, Troy, MI (US)

(72) Inventors: Ryan D. Lewis, Warren, OH (US); Michael D. Messuri, Canfield, OH (US); Shae R. McGarvey, Leola, PA (US); Crystal F. Krompegel, Confield, OH (US); Michael J. Demonica, Cortland, OH (US)

(73) Assignee: DELPHI TECHNOLOGIES, LLC, Troy, MI (US)

( * ) Notice: Subject to any disclaimer, the term of this patent is extended or adjusted under 35 U.S.C. 154(b) by 0 days.

(21) Appl. No.: 15/935,375

(22) Filed: Mar. 26, 2018

(51) Int. Cl.
*B21D 41/00* (2006.01)
*H01R 9/05* (2006.01)
*H01R 43/048* (2006.01)

(52) U.S. Cl.
CPC ..... *H01R 9/0518* (2013.01); *H01R 43/048* (2013.01)

(58) Field of Classification Search
CPC .... B21J 7/14; B21F 1/00; B21B 19/04; B21D 15/04
USPC ..... 72/402, 403, 367.1, 370.21
See application file for complete search history.

(56) References Cited

U.S. PATENT DOCUMENTS 8,827,744 B2 * 9/2014 Poma ..... H01R 4/20 439/585

* cited by examiner

*Primary Examiner* — Phuong Chi T Nguyen
(74) *Attorney, Agent, or Firm* — Robert J. Myers

(57) ABSTRACT

An assembly includes an elongate conductor, such as a coaxial electrical cable, having a generally circular cross section and a generally cylindrical seamless outer ferrule having a ferrule radius surrounding a portion of the conductor. The outer ferrule is deformed to define four indentations and four projections that are evenly spaced about a circumference of the outer ferrule. The four indentations have a consistent indentation radius that is less than the ferrule radius.

8 Claims, 9 Drawing Sheets

CONDUCTOR ASSEMBLY WITH A CRIMPED TUBULAR FERRULE AND METHOD OF MANUFACTURING SAME

TECHNICAL FIELD OF THE INVENTION

The invention generally relates to a conductor assembly particularly a conductor assembly including a tubular ferrule.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Presented herein is a conductor assembly that includes a seamless tubular ferrule that is crimped to an elongate conductor. The tubular ferrule is deformed in a crimping process to attach the ferrule to the conductor. After crimping, the ferrule defines four indentations having a consistent radius and four projections evenly spaced about a circumference of the ferrule. A tool used to deform the ferrule which limits the height four projections is also presented herein.

Figure 1:
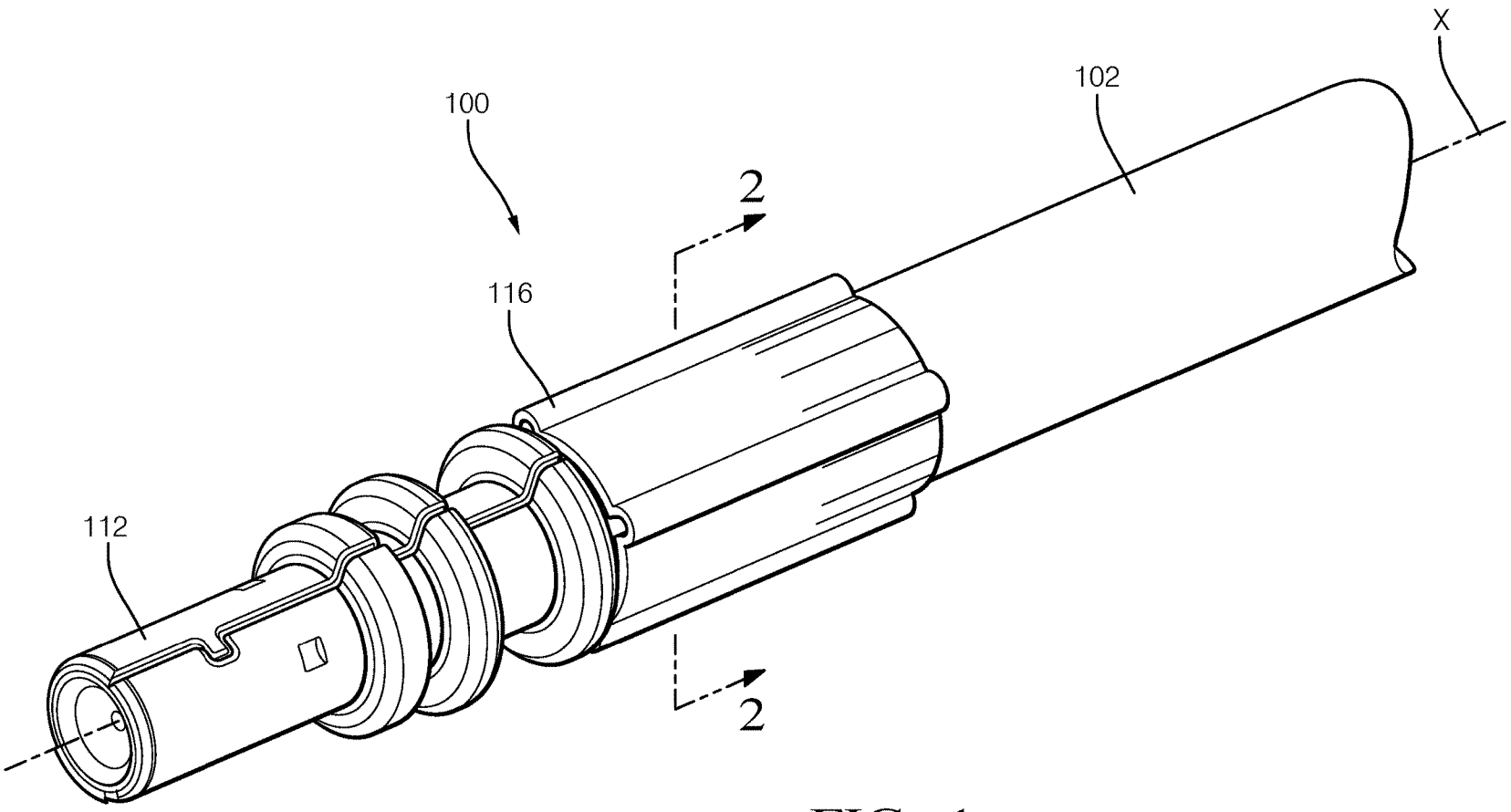
FIG. 1 is a perspective view of a conductor assembly including a crimped tubular ferrule according to one embodiment.
Figure 2:
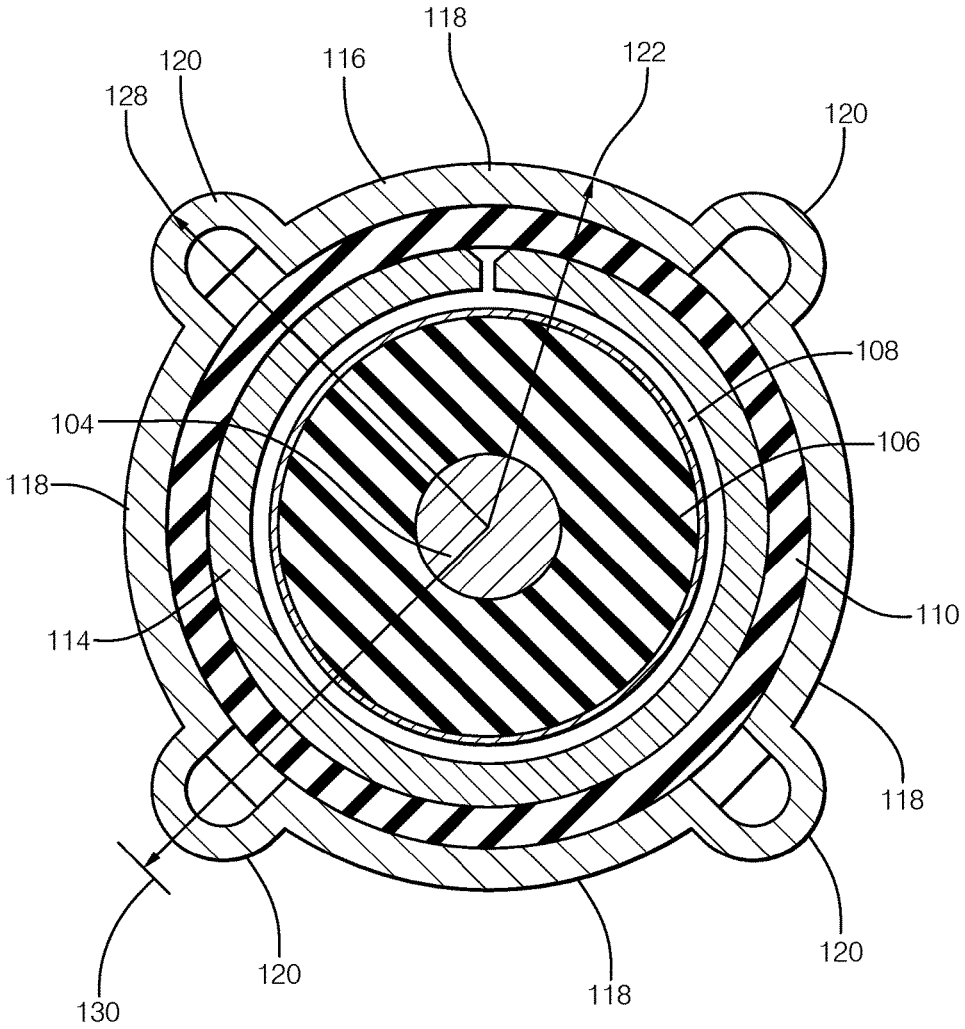
FIG. 2 is a cross section view of the conductor assembly of FIG. 1 according to one embodiment.
Figure 3:
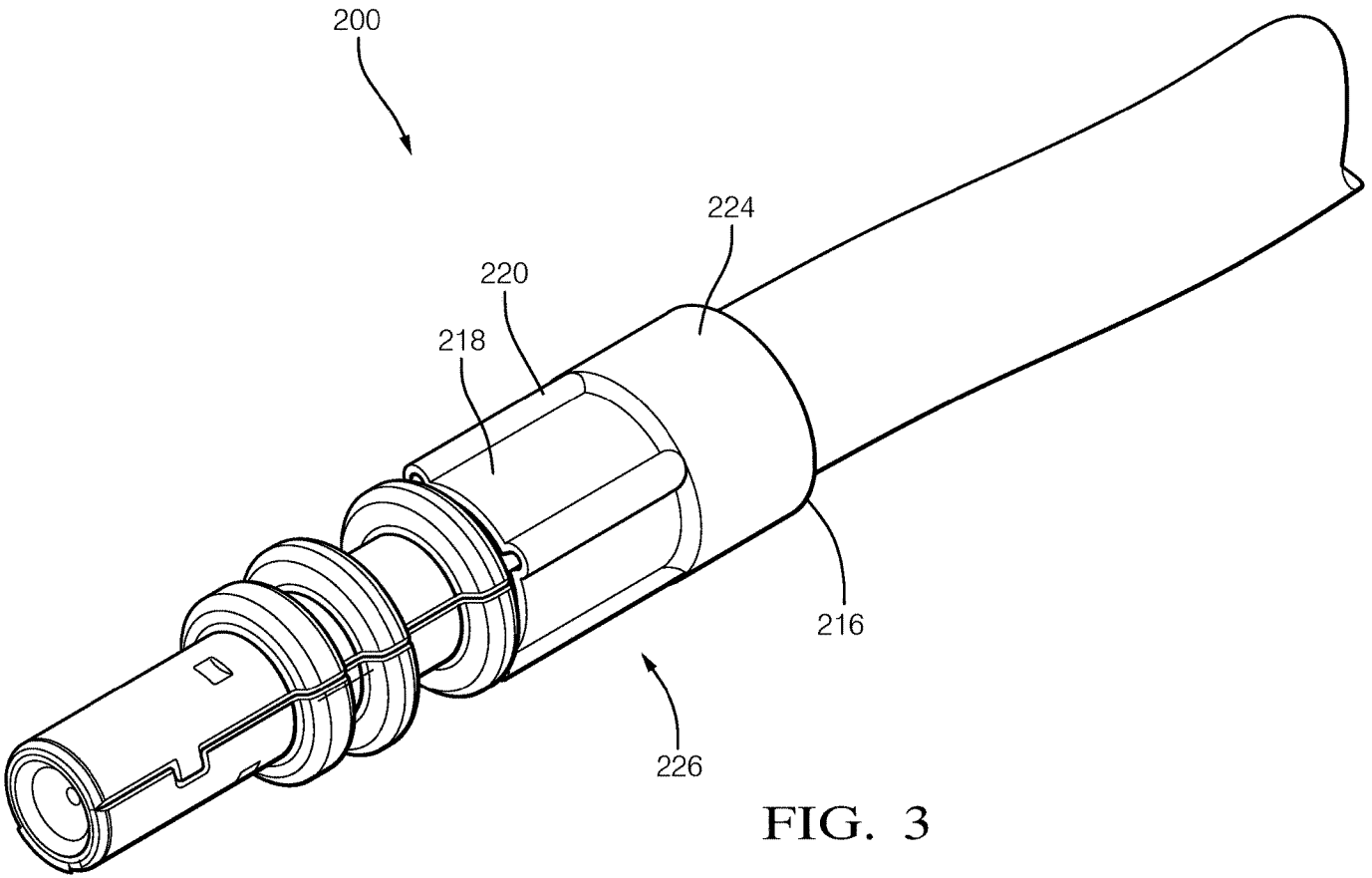
FIG. 3 is a perspective view of a conductor assembly including a crimped tubular ferrule according to one embodiment.

FIGS. 1-3 illustrate a non-limiting example of a conductor assembly 100, hereinafter referred to as the assembly 100. As shown in FIG. 3, the assembly 100 includes an elongate conductor, in this particular example a coaxial electrical cable 102. The coaxial cable 102 has a central inner conductor 104, an inner insulator 106 surrounding the inner conductor 104, an outer conductor 108 surrounding the inner insulator 106, and an outer insulator 110 surrounding the outer conductor 108. As shown in FIG. 2, the coaxial cable 102 has a generally circular cross section.

The assembly 100 also includes a conductive inner terminal (not shown) connected to the inner conductor 104 and a conductive outer terminal 112 surrounding the inner terminal and connected to the outer conductor 108. The outer terminal 112 defines a tubular inner ferrule 114 that is disposed intermediate the inner insulator 106 and the outer insulator 110. According to the particular example illustrated in FIG. 2, the inner ferrule 114 is located intermediate the outer insulator 110 and the outer conductor 108. A terminal insulator is disposed between the inner terminal and the outer terminal 112.

Figures 9A, 9B:
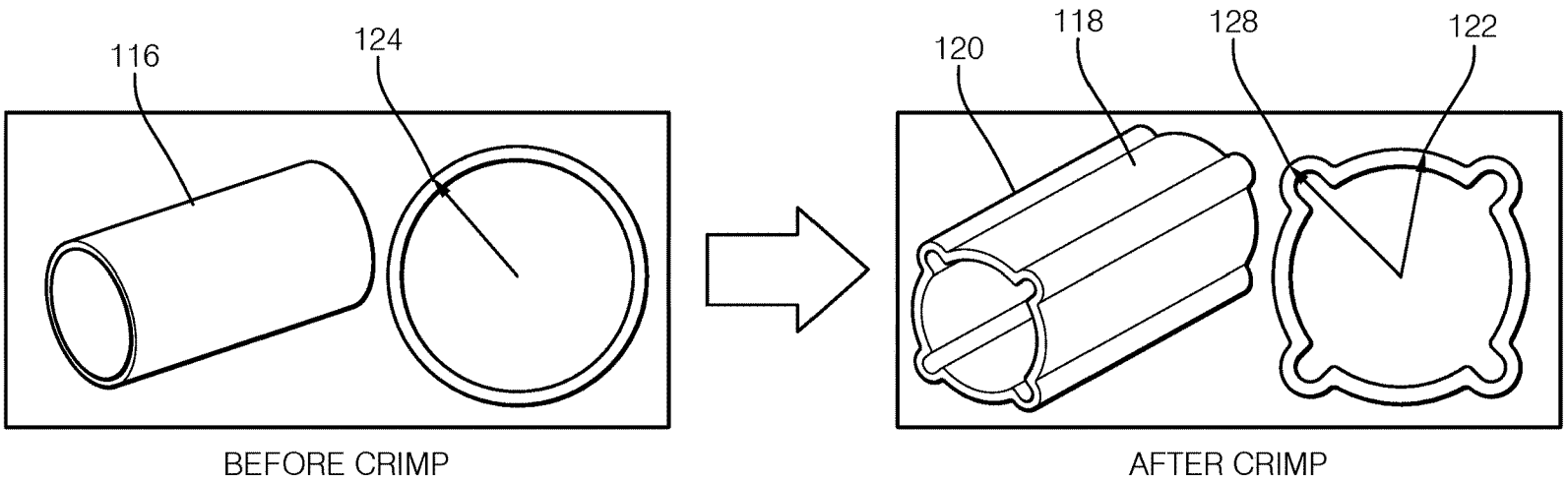
FIG. 9A is a perspective and end view of a tubular ferrule of the conductor assembly of FIGS. 1 and 3 prior to forming with the crimping tool of FIG. 4 or 7 according to one embodiment.
FIG. 9B is a perspective and end view of the tubular ferrule of the conductor assembly of FIG. 9A after forming with the crimping tool of FIG. 4 or 7 according to one embodiment.

The assembly 100 further includes a generally cylindrical seamless outer ferrule 116 having a surrounding a portion of the outer insulator 110 overlying the inner ferrule 114. The outer ferrule 116 is deformed by a crimping tool 300 to define four indentations 118 extending along the outer ferrule 116 in a direction generally parallel to the longitudinal axis X of the outer ferrule 116. Each of the four indentations 118 have the same consistent indentation radius 122. The deformation produces four projections 120 extending along the outer ferrule 116 in a direction generally parallel to the longitudinal axis of the outer ferrule 116. The four indentations 118 and the four projections 120 are evenly spaced about a circumference of the outer ferrule 116. Adjacent indentations 118 of the four indentations 118 are spaced approximately 90 degrees apart about the longitudinal axis of the outer ferrule 116. As used herein, approximately 90 degrees apart is within a range of 80 to 100 degrees apart. As best shown in FIG. 2, one of the four projections 120 is located intermediate the adjacent indentations 118. Adjacent projections 120 of the four projections 120 are also spaced approximately 90 degrees apart about the longitudinal axis of the outer ferrule 116. As shown in FIGS. 9A and 9B, the indentation radius 122 of the four indentations 118 is less than the original ferrule radius 124 of the outer ferrule 116 prior to deformation by the crimping tool 300.

The height 128 of each of the four projections 120 is controlled during the crimping process 500 so that each of the four projections 120 is equal to or less than a height threshold 130. Control of the projection height 128 is discussed in more detail in the description of the crimping tool 300 below.

As shown in FIG. 1, the four indentations 118 and the four projections 120 extend along the entire length of the outer ferrule 116. According to an alternative embodiment of the assembly 200 shown in FIG. 3, only a central portion 226 of the outer ferrule 216 is deformed to form the four indentations 218 and the four projections 220. The ends of the outer ferrule 216 retain the original ferrule radius 224.

Figure 4:
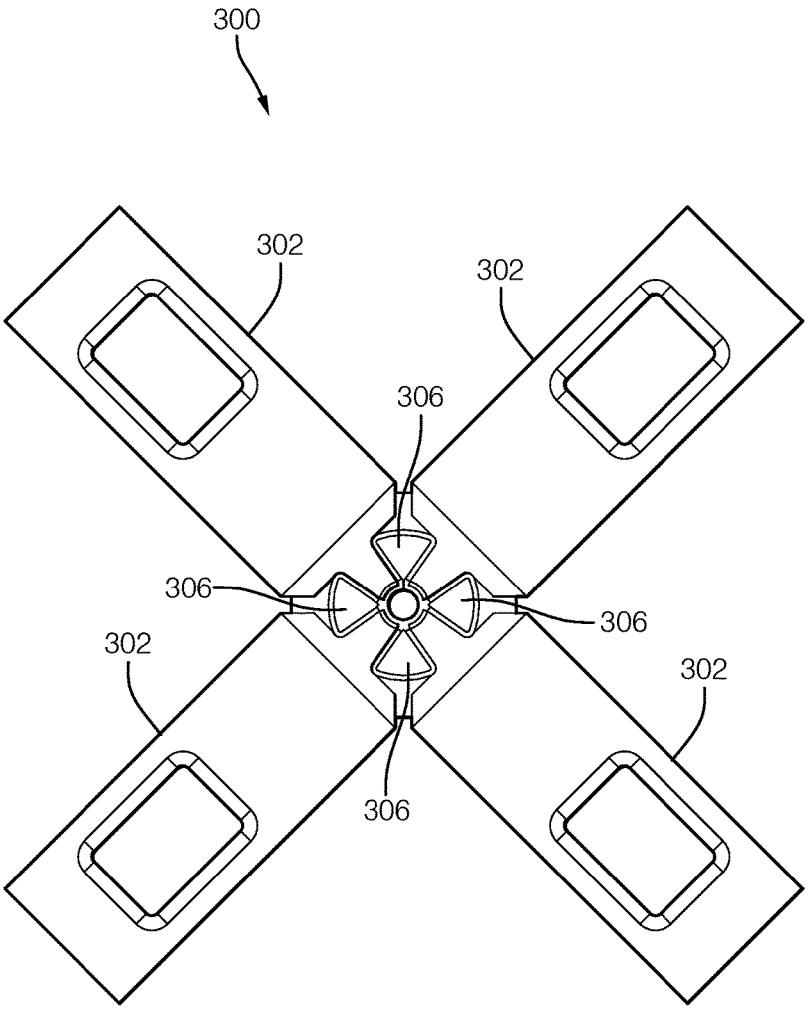
FIG. 4 is a front end view of a crimping tool having fixed limiting dies used to form the tubular ferrule of the conductor assembly of FIG. 1 or 3 according to one embodiment.
Figure 5:
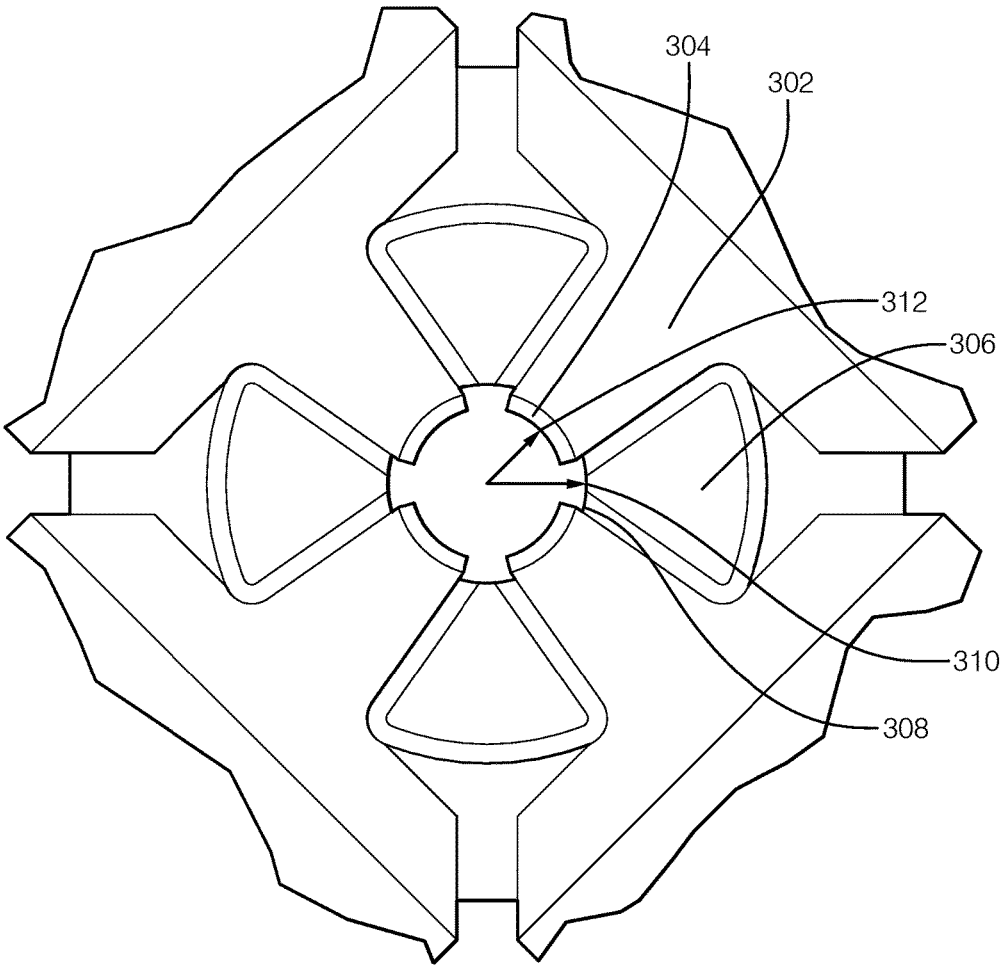
FIG. 5 is a close up front end view of the crimping dies and limiting dies of the crimping tool of FIG. 4 according to one embodiment.
Figure 6:
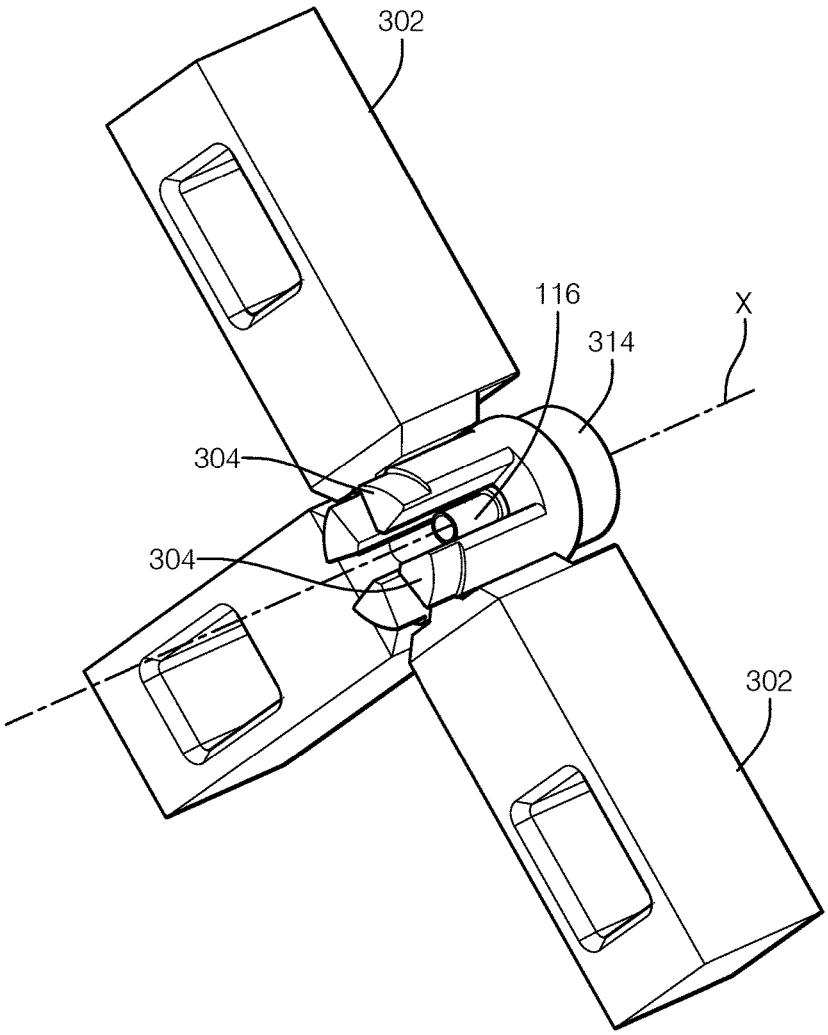
FIG. 6 is a perspective side view of the crimping tool of FIG. 4 with one of the crimping dies removed to better show the limiting dies according to one embodiment.

FIGS. 4-6 illustrate a non-limiting example of a crimping tool 300 used to crimp the outer ferrule 116, 216 of the coaxial cable assembles 100, 200 shown in FIGS. 1 and 3. The crimping tool 300 is configured to form the four evenly spaced indentations 118, 218 and the four evenly spaced projections 120, 220 about the circumference of the outer ferrule 116. As shown in FIG. 4, the crimping tool 300 includes four crimping dies 302. Each crimping die 302 of the four crimping dies 302 defines a concave crimping surface 304 having an indentation radius 312 that is substantially equal to the indentation radius 122 of the formed outer ferrule 116. The crimping tool 300 also includes four limiting dies 306. As best shown in FIG. 5, each limiting die 306 defines a concave limiting surface 308 having a limiting radius 310 that is greater than the indentation radius 312 of the crimping dies 302. The limiting dies 306 are configured to limit the height 128 of each projection to the height threshold and are located intermediate two adjacent crimping dies 302 of the four crimping dies 302. Adjacent crimping dies 302 are spaced approximately 90 degrees apart about a longitudinal axis of the crimping tool 300. Adjacent limiting dies 306 of the four limiting dies 306 are also spaced approximately 90 degrees apart about the longitudinal axis of the crimping tool 300.

Each limiting surface 308 is spaced at a distance of the limiting radius 310 from the longitudinal axis of the ferrule. This limiting radius 310 is equal to the original ferrule radius 124 plus the height threshold of the four protrusions of the outer ferrule 116.

According to the embodiment of the crimping tool 300 shown in FIG. 6, the four limiting dies 306 are integrally formed in a single die assembly 314 and are fixed such that each limiting surface 308 remains at the distance of the limiting radius 310 as the four crimping dies 302 move relative to the longitudinal axis of the tool 300.

Figure 7:
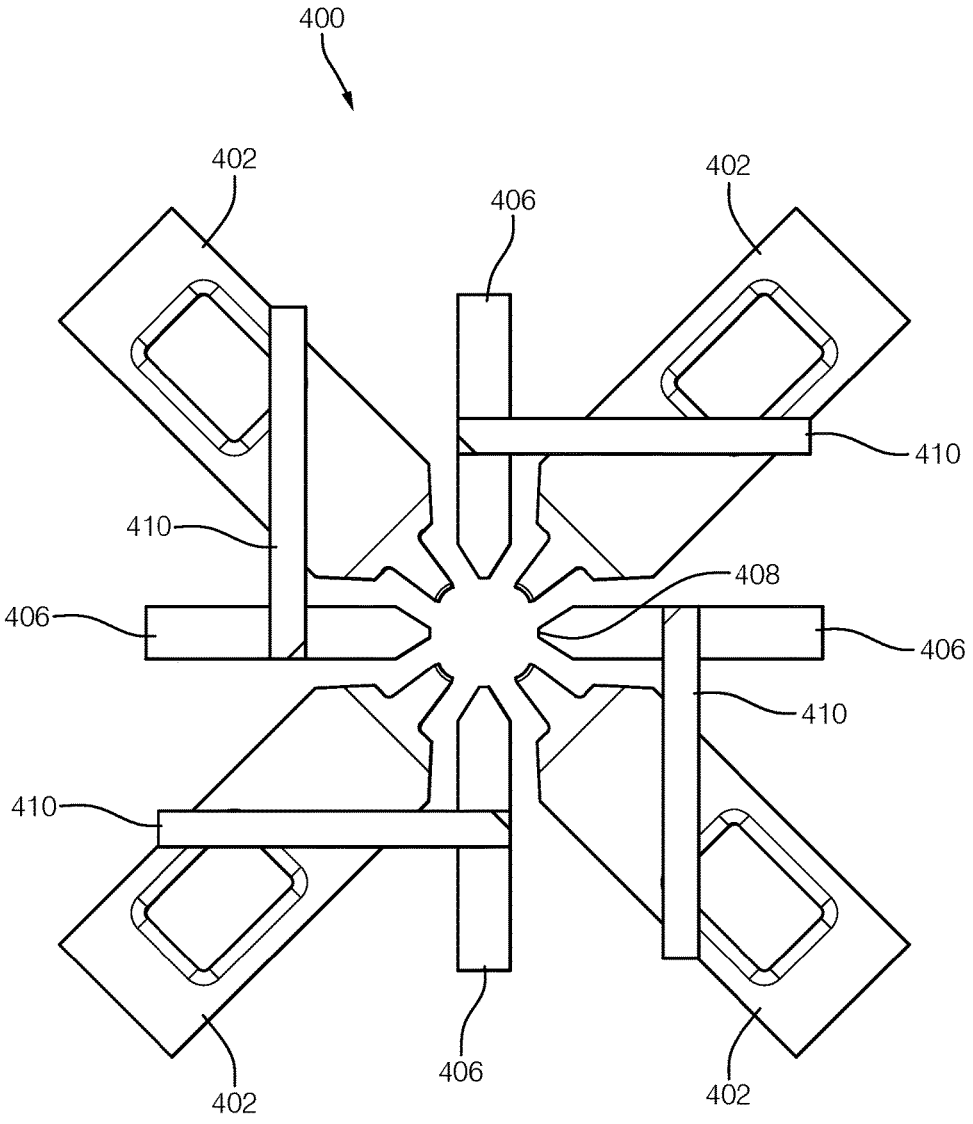
FIG. 7 is a front end view of a crimping tool having moveable limiting dies used to form the tubular ferrule of the conductor assembly of FIG. 1 or 3 according to one embodiment.

According to an alternative embodiment of the crimping tool 400 shown in FIG. 7, the crimping tool 400 further includes four linkages 410 between each crimping die 402 and an adjoining limiting die 406. The four linkages 410 are configured to move each limiting die 406 and hence each limiting surface 408 to the distance of the limiting radius 310 as the four crimping dies 402 move toward the longitudinal axis of the tool 400 as the crimping tool 400 deforms the outer ferrule 116 of the coaxial cable assembly 100.

Figure 8:
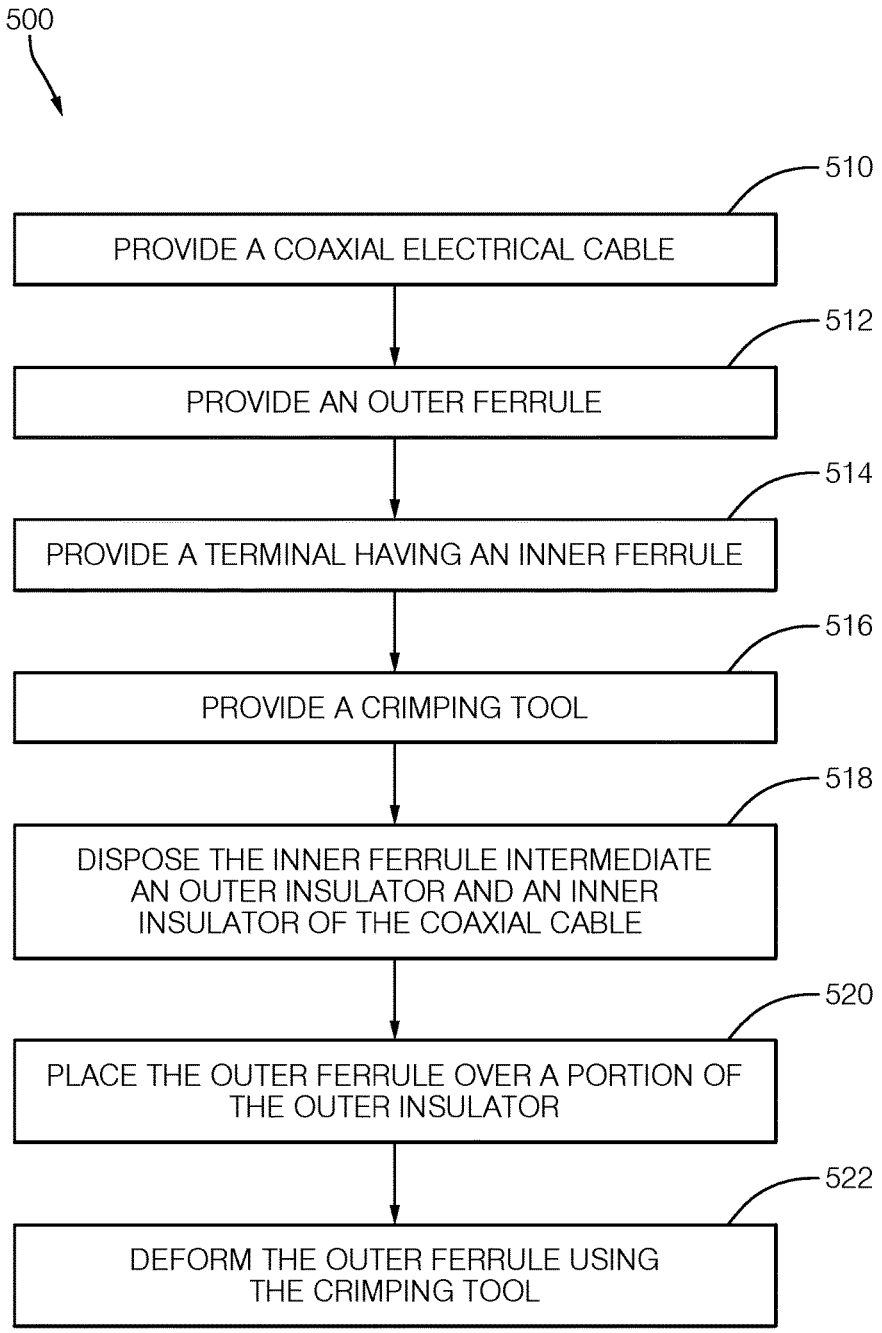
FIG. 8 is a flow chart of a method of manufacturing the conductor assemblies of FIG. 1 or 3 using the crimping tool of FIG. 4 or FIG. 7 according to one embodiment.

FIG. 8 describes a method 500 of manufacturing the coaxial cable assembly 100 described above. The method 500 includes the following steps:

STEP 510, PROVIDE A COAXIAL ELECTRICAL CABLE, includes providing a coaxial electrical cable 102 comprising a central inner conductor 104, an inner insulator 106 surrounding the inner conductor 104, an outer conductor 108 surrounding the inner insulator 106, and an outer insulator 110 surrounding the inner insulator 106;

STEP 512, PROVIDE AN OUTER FERRULE, includes providing a generally cylindrical seamless outer ferrule 116 having a ferrule radius 124;

STEP 514, PROVIDE A TERMINAL HAVING AN INNER FERRULE, is an optional step that includes providing a terminal 112 having an inner ferrule 114;

STEP 516, PROVIDE A CRIMPING TOOL, includes providing a crimping tool 300 including four crimping dies 302 each having a die face 304 defining a consistent indentation radius 312 that is less than the ferrule radius 124;

STEP 518, DISPOSE THE INNER FERRULE INTERMEDIATE AN OUTER INSULATOR AND AN INNER INSULATOR OF THE COAXIAL CABLE, is an optional step that includes disposing the inner ferrule 114 intermediate the outer insulator 110 and the inner insulator 106 prior to STEP 522, DEFORM THE OUTER FERRULE USING THE CRIMPING TOOL;

STEP 520, PLACE THE OUTER FERRULE OVER A PORTION OF THE OUTER INSULATOR, includes placing the outer ferrule 116 over a portion of the outer insulator 110; and STEP 522, DEFORM THE OUTER FERRULE USING THE CRIMPING TOOL, includes deforming the outer ferrule 116 using the crimping tool 300, 400 to form four indentations 118 and four projections 120 in the outer ferrule 116 that are evenly spaced about a circumference of the outer ferrule 116. The outer ferrule is held between the four crimping dies so that the longitudinal axis of the outer ferrule is substantially coincident with the longitudinal axis of the crimping tool. The four crimping dies are brought simultaneously toward the longitudinal axes to provide substantially consistent pressure and deformation rates when forming the four indentations and the four projections. The four indentations 118 each are characterized as having the indentation radius 122.

The four crimping dies 302 are spaced approximately 90 degrees apart about the longitudinal axis of the crimping tool. After deformation of the outer ferrule, adjacent indentations 118 of the four indentations 118 are spaced approximately 90 degrees apart about the longitudinal axis of the outer ferrule 116. One of the four projections 120 is located intermediate the adjacent indentations 118. Adjacent projections 120 of the four projections 120 are spaced approximately 90 degrees apart about the longitudinal axis of the outer ferrule 116.

Accordingly, a coaxial electrical cable assembly is provided. The consistent radius of the indentations and the limited height of the projections reduces the variation in capacitance between the inner and outer conductors of the coaxial cable in the area of the outer ferrule, thereby reducing the variation of impedance along the coaxial cable assembly which provides improved insertion loss performance. The outer ferrule, as formed with the four indentations and four projections, also provides improved retention of the outer ferrule and the outer terminal (by retention of the inner ferrule) to the assembly. The outer ferrule, as formed with the four indentations and four projections, is also more easily accommodated into existing connector body designs having generally cylindrical connector cavities in which the coaxial cable assembly is received.

Accordingly, a crimping tool configured to form the four indentations and four projections in the outer ferrule is also provided. The tool includes four crimping dies to form the four indentations in the outer ferrule. The tool also inclines four limiting dies that limit growth of the four projections so that the four projections do not exceed a maximum height threshold. The crimping tool, when used with the outer ferrule, provides all of the benefits listed above.

The example presented herein is directed to a coaxial electrical cable assembly, however other embodiments may be envisioned that are adapted for use with other types of shielded or unshielded electrical cables. Yet other embodiments of the assembly may be envisioned wherein the conductors are fiber optic cables, pneumatic tubes, or hydraulic tubes.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'One or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. Moreover, the use of the terms first, second, etc. does not denote any order of importance, but rather the terms first, second, etc. are used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, directional terms such as upper, lower, etc. do not denote any particular orientation, but rather the terms upper, lower, etc. are used to distinguish one element from another and establish a relationship between the various elements.

We claim:

1. An assembly, comprising:

an elongate conductor having a generally circular cross section; and a generally cylindrical seamless outer ferrule having a ferrule radius surrounding a portion of the conductor, wherein the outer ferrule is deformed define four indentations and four projections evenly spaced around a circumference of the outer ferrule, wherein the four indentations have a consistent indentation radius less than the ferrule radius, wherein centers of adjacent indentations of the four indentations are spaced approximately 90 degrees apart around a longitudinal axis of the outer ferrule, wherein one of the four projections is located intermediate the adjacent indentations, wherein centers of adjacent projections of the four projections are spaced approximately 90 degrees apart around the longitudinal axis of the outer ferrule, wherein the elongate conductor is a coaxial electrical cable comprising a central inner conductor, an inner insulator surrounding the inner conductor, an outer conductor surrounding the inner insulator, and an outer insulator surrounding the outer conductor, and wherein the outer ferrule surrounds a portion of the outer insulator.

2. The assembly according to claim 1, further comprising a terminal having an inner ferrule disposed intermediate the outer insulator and the inner insulator.

3. The assembly according to claim 1, wherein a portion of the outer ferrule retains the ferrule radius after deformation.

4. A method of manufacturing a coaxial cable assembly comprising the steps of:

providing a coaxial electrical cable comprising a central inner conductor, an inner insulator surrounding the inner conductor, an outer conductor surrounding the inner insulator, and an outer insulator surrounding the inner insulator;

providing a generally cylindrical seamless outer ferrule having a ferrule radius;

providing a crimping tool including four crimping dies each having a die face defining a consistent indentation radius that is less than the ferrule radius;

placing the outer ferrule over a portion of the outer insulator;

deforming the outer ferrule using the crimping tool to form four indentations and four projections in the outer ferrule that are evenly spaced around a circumference of the outer ferrule, wherein the four indentations each are characterized as having the indentation radius;

providing a terminal having an inner ferrule; and disposing the inner ferrule intermediate the outer insulator and the inner insulator prior to the step of deforming the outer ferrule, wherein the four crimping dies are spaced approximately 90 degrees apart around a longitudinal axis of the outer ferrule, wherein centers of adjacent indentations of the four indentations are spaced approximately 90 degrees apart around the longitudinal axis of the outer ferrule, wherein one of the four projections is located intermediate the adjacent indentations, and wherein centers of adjacent projections of the four projections are spaced approximately 90 degrees apart around the longitudinal axis of the outer ferrule.

5. The method according to claim 4, wherein a portion of the outer ferrule retains the ferrule radius after deformation.

6. A coaxial cable assembly formed by a method comprising the steps of:

providing a coaxial electrical cable comprising a central inner conductor, an inner insulator surrounding the inner conductor, an outer conductor surrounding the inner insulator, and an outer insulator surrounding the inner insulator;

providing a generally cylindrical seamless outer ferrule having a ferrule radius;

providing a crimping tool including four crimping dies each having a die face defining a consistent indentation radius that is less than the ferrule radius;

placing the outer ferrule over a portion of the outer insulator; and deforming the outer ferrule using the crimping tool to form four indentations and four projections in the outer ferrule that are evenly spaced around a circumference of the outer ferrule, wherein the four indentations are characterized as having the indentation radius, wherein the four crimping dies are spaced approximately 90 degrees apart around a longitudinal axis of the outer ferrule, wherein centers of adjacent indentations of the four indentations are spaced approximately 90 degrees apart around the longitudinal axis of the outer ferrule, wherein one of the four projections is located intermediate the adjacent indentations, and wherein centers of adjacent projections of the four projections are spaced approximately 90 degrees apart around the longitudinal axis of the outer ferrule.

7. The coaxial cable assembly according to claim 6, wherein the method further comprises the steps of:

providing a terminal having an inner ferrule; and disposing the inner ferrule intermediate the outer insulator and the inner insulator prior to the step of deforming the outer ferrule.

8. The coaxial cable assembly according to claim 6, wherein a portion of the outer ferrule retains the ferrule radius after deformation.

* * * * *